US012751510B2

(12) United States Patent
Hsu et al.

(10) Patent No.: US 12,751,510 B2
(45) Date of Patent: Oct. 6, 2026

(54) MULTIMODAL METALLIZATION SYSTEMS FOR THERMOREGULATION AND METHODS THEREOF

(71) Applicant: Duke University, Durham, NC (US)

(72) Inventors: Po-Chun Hsu, Durham, NC (US); Xiuqiang Li, Durham, NC (US); Boran Ma, Durham, NC (US); Catherine Brinson, Durham, NC (US)

(73) Assignee: Duke University, Durham, NC (US)

( * ) Notice: Subject to any disclaimer, the term of this patent is extended or adjusted under 35 U.S.C. 154(b) by 865 days.

(21) Appl. No.: 18/054,640

(22) Filed: Nov. 11, 2022

(65) Prior Publication Data

US 2023/0142369 A1 May 11, 2023

Related U.S. Application Data

(60) Provisional application No. 63/278,305, filed on Nov. 11, 2021.

(51) Int. Cl.

| | |
|---|---|
| ***A41D 27/28*** | (2006.01) |
| ***A41D 31/06*** | (2019.01) |
| ***A41D 31/12*** | (2019.01) |
| ***D06M 11/77*** | (2006.01) |
| ***D06M 11/83*** | (2006.01) |
| ***D06M 15/693*** | (2006.01) |
| ***D06M 101/34*** | (2006.01) |

(52) U.S. Cl.

CPC ..... *A41D 27/28* (2013.01); *A41D 31/065* (2019.02); *A41D 31/12* (2019.02); *D06M 11/77* (2013.01); *D06M 11/83* (2013.01); *D06M 15/693* (2013.01); *D06M 2101/34* (2013.01)

(58) Field of Classification Search

CPC .... A41D 31/065; A41D 31/126; A41D 31/12; A41D 27/28; A41D 13/002; D06M 11/77; D06M 11/83; D06M 15/693; D06M 2101/34; D02G 3/26; D03D 15/567; F03G 7/06

USPC ..... 442/76

See application file for complete search history.

(56) References Cited

FOREIGN PATENT DOCUMENTS

WO WO-2017165435 A2 * 9/2017 ..... D02G 3/26

OTHER PUBLICATIONS

Fu, Kun , et al., "Designing textile architectures for high energy-efficiency human body sweat- and cooling-management", Advanced Fiber Materials 1, 61-70 (2019).

Mu, Jiuke , et al., "Molecular-channel driven actuator with considerations for multiple configurations and color switching", Nat Commun 9, 590 (2018), 10 pages.

(Continued)

*Primary Examiner* — Camie S Thompson

(74) *Attorney, Agent, or Firm* — Myers Bigel, P.A.

(57) ABSTRACT

The present disclosure describes a multimodal adaptive textile with moisture-responsive flaps composed of a nylon/metal heterostructure, which can simultaneously regulate convection, sweat evaporation, and mid-infrared emission to accomplish heat transfer tuning in response to human perspiration vapor. A metal layer contributes to low-emissivity radiative heating and enhances the bimorph actuation performance. The multimodal adaptive mechanism expands the thermal comfort zone compared to traditional static textiles and single-modal adaptive textiles without any electricity or energy input.

20 Claims, 10 Drawing Sheets

(56) References Cited

OTHER PUBLICATIONS

Wang, Wen , et al., "Harnessing the hygroscopic and biofluorescent behaviors of genetically tractable microbial cells to design biohybrid wearables", Science advances 3, e1601984 (2017), 8 pages.
Zhang, Xu A., et al., "Dynamic gating of infrared radiation in a textile", Science, 363, 619-623, (2019).
Zhong, Ying , et al., "Reversible humidity sensitive clothing for personal thermoregulation", Sci Rep 7, 44208 (2017), 8 pages.

* cited by examiner

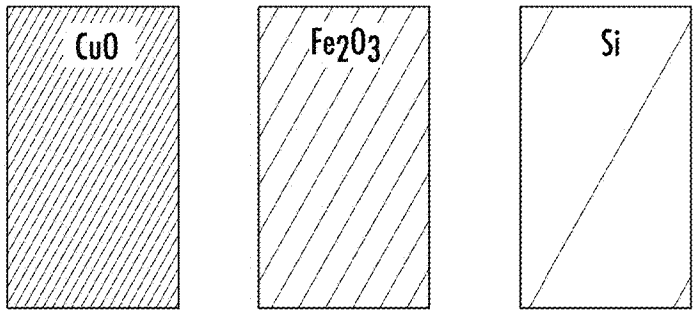
FIG. 5A
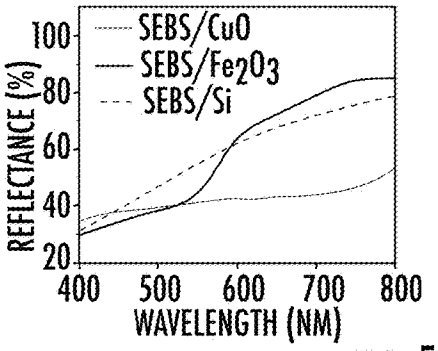
FIG. 5B
FIG. 5C
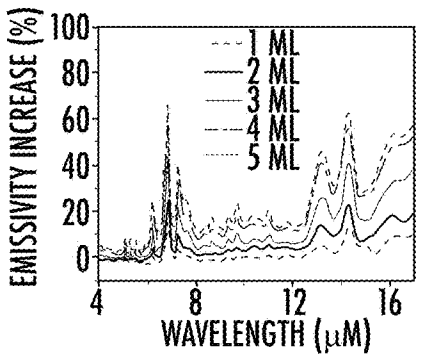
FIG. 5D
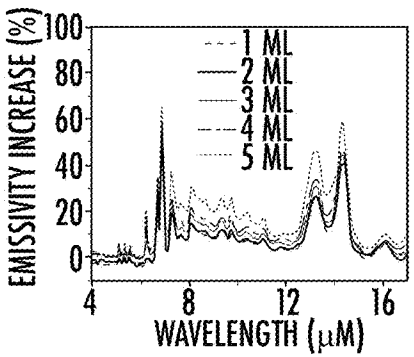
FIG. 5E
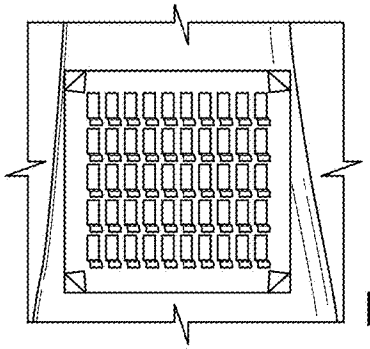
FIG. 5F
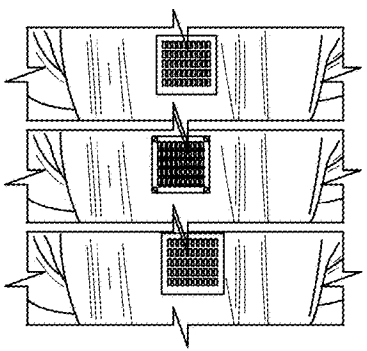
FIG. 5G
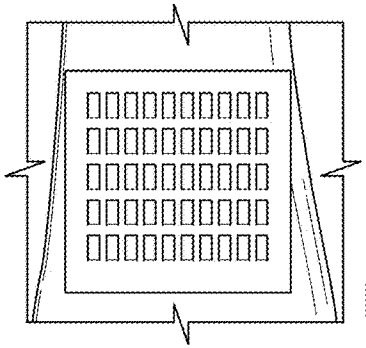
FIG. 5H

MULTIMODAL METALLIZATION SYSTEMS FOR THERMOREGULATION AND METHODS THEREOF

RELATED APPLICATIONS

This application claims priority from U.S. Provisional Patent Application Ser. No. 63/278,305, filed Nov. 11, 2021, the disclosure of which is incorporated by reference in its entirety.

FEDERAL FUNDING LEGEND

This invention was made with Government support from the National Science Foundation DMREF program (CMMI-1818574) and the National Science Foundation CSSI program (CSSI-1835677). The Federal Government has certain rights to this invention.

BACKGROUND

Building energy consumption currently contributes over 30% of global energy consumption and ~20% of global greenhouse gas emissions. Among these, half of the energy is used for building heating and cooling management. Moreover, owing to the rapid population growth and climate change, it is predicted that the percentage for heat management will continue to grow towards ~80% by the end of 2050. The fundamental reason for the enormous energy consumption lies in our demand for thermal homeostasis that is indispensable for health and productivity. Creating innovative solutions to overcome this energy-health dilemma has become a critical research topic for scientists and engineers in recent years. Personal thermal management based on smart textile/wearable is a promising and effective strategy to reduce heating, ventilation and air conditioning (HVAC) energy consumption by focusing on the local environment around the human body instead of the entire building interior space. Hence, there is an ongoing opportunity for improvements in this field.

SUMMARY

The Summary is provided to introduce a selection of concepts that are further described below in the Detailed Description. This Summary is not intended to identify key or essential features of the claimed subject matter, nor is it intended to be used as an aid in limiting the scope of the claimed subject matter.

One aspect of the present disclosure provides all that is described and illustrated herein.

Some embodiments of the present invention are directed to a multimodal wearable for thermoregulation, including: a multilayer body comprising a hygroscopic polymer layer and a metal layer on the hygroscopic polymer layer; and an array of a plurality of flaps pivotally connected the body. The flaps move from a closed state to an open state in response to human perspiration vapor.

In some embodiments, the hygroscopic polymer layer includes nylon.

In some embodiments, the metal layer includes silver.

In some embodiments, the metal layer has a thickness of about 50 nm±50% (e.g., 25 mm to 75 mm). The metal layer may have a thickness of 50 nm or about 50 nm.

In some embodiments, each of the flaps is flat on the body in the closed state and is at a bend angle relative to the body in the open state. The bend angle may be at least 200 degrees at 80% relative humidity.

In some embodiments, the plurality of flaps cover at least 75% or 80% of an area of the body.

In some embodiments, the emissivity of the wearable is less than 0.2 with the plurality of flaps in the closed state.

In some embodiments, the wearable further includes a color layer on the metal layer.

In some embodiments, the color layer includes a polymer layer with nanoparticles dispersed therein.

In some embodiments, the nanoparticles include CuO nanoparticles to provide a black visual appearance.

In some embodiments, the nanoparticles include $Fe_2O_3$ nanoparticles to provide a brown visual appearance.

In some embodiments, the nanoparticles include Si nanoparticles to provide a light yellow visual appearance.

In some embodiments, the polymer layer includes styrene-ethylene-butadiene-styrene (SEBS).

In some embodiments, the flaps pivot and/or curl in response to human perspiration vapor to thereby expose openings in the body.

In some embodiments, the flaps are in the closed state at a relative humidity of about 40% or less, the flaps are in the open state at a relative humidity of about 80% or greater, and wherein the flaps are in a partially open state at relative humidity of between about 40% and about 80%.

Some other embodiments of the present invention are directed to a method of providing thermoregulation using a multimodal wearable, the method including: providing a multimodal wearable including a multilayer body comprising a nylon layer and a metal layer on the nylon layer, and an array of a plurality of flaps connected the body; placing the wearable adjacent a human body; and automatically moving the flaps between a closed, flat state and an open state in response to a level of perspiration vapor from the human body.

In some embodiments, in the open state, the flaps expose openings in the body in the open state to promote convection, radiation, and perspiration evaporation through the openings.

In some embodiments, in the closed state, the flaps cover the openings such that the metal layer is continuous and has low emissivity to suppress radiation heat loss.

Some other embodiments of the present invention are directed to an article of clothing including: a multilayer body comprising a nylon layer and a silver layer on the nylon layer; and an array of a plurality of flaps hingedly connected the body. The flaps move to an open state in response to human perspiration vapor generating a relative humidity greater than a first threshold level (e.g., 80% RH). The flaps move to a closed state in response to human perspiration vapor generating a relative humidity less than a second threshold level (e.g., 40% RH). A plurality of openings are formed in the body when the flaps are in the open state to promote convection, radiation, and perspiration evaporation. The silver layer is continuous with the flaps in the closed state to provide a low-emissivity layer to suppress radiation heat loss.

The accompanying Figures are provided by way of illustration and not by way of limitation. The foregoing aspects and other features of the disclosure are explained in the following description, taken in connection with the accompanying example figures (also "FIG.") relating to one or more embodiments.

BRIEF DESCRIPTION OF THE DRAWINGS

FIG. 5A includes digital images of nylon-Ag wearable with SEBS nanocomposites of CuO/SEBS, $Fe_2O_3$/SEBS, and Si/SEBS, respectively.

FIG. 5B is a chart illustrating visible reflectance spectra of nylon-Ag wearable (6 cm by 6 cm) with CuO/SEBS (5 ml), $Fe_2O_3$ nanoparticles/SEBS (5 ml), and Si nanoparticles/SEBS (5 ml).

FIGS. 5C-5E are charts illustrating emissivity increases of nylon-Ag wearable with different amount of CuO/SEBS, $Fe_2O_3$/SEBS, and Si/SEBS, respectively.

FIG. 5F includes digital images of wearable (6 cm by 6 cm) before, during, and after exercise. The moisture-responsive actuator switch between flat and curved well with the human sweat vapor in real situations.

FIG. 5G is an enlarged view of the wearable at the curved (during exercise) state.

FIG. 5H is an enlarged view of the wearable at the flat state (cooled down).

DETAILED DESCRIPTION

Figure 1A:
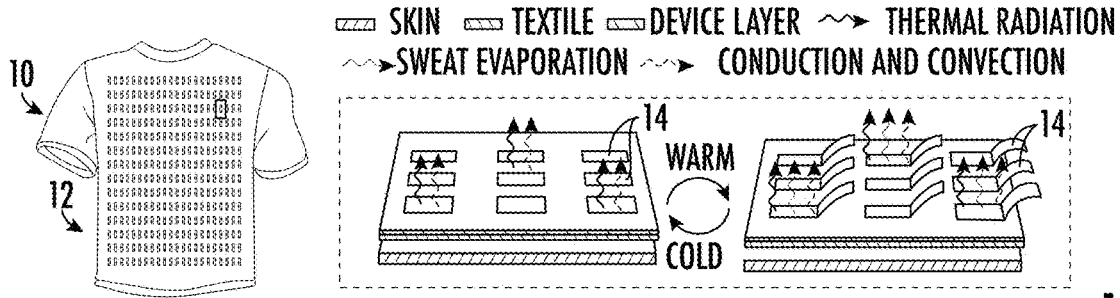
FIG. 1A is a schematic diagram illustrating the concept and mechanism of nylon-Ag heterostructure moisture-responsive wearable according to some embodiments.

For the purposes of promoting an understanding of the principles of the present disclosure, reference will now be made to preferred embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Articles "a" and "an" are used herein to refer to one or to more than one (i.e. at least one) of the grammatical object of the article. By way of example, "an element" means at least one element and can include more than one element.

"About" is used to provide flexibility to a numerical range endpoint by providing that a given value may be "slightly above" or "slightly below" the endpoint without affecting the desired result.

The use herein of the terms "including," "comprising," or "having," and variations thereof, is meant to encompass the elements listed thereafter and equivalents thereof as well as additional elements. As used herein, "and/or" refers to and encompasses any and all possible combinations of one or more of the associated listed items, as well as the lack of combinations where interpreted in the alternative ("or").

As used herein, the transitional phrase "consisting essentially of" (and grammatical variants) is to be interpreted as encompassing the recited materials or steps "and those that do not materially affect the basic and novel characteristic(s)" of the claimed invention. Thus, the term "consisting essentially of" as used herein should not be interpreted as equivalent to "comprising."

Moreover, the present disclosure also contemplates that in some embodiments, any feature or combination of features set forth herein can be excluded or omitted. To illustrate, if the specification states that a complex comprises components A, B and C, it is specifically intended that any of A, B or C, or a combination thereof, can be omitted and disclaimed singularly or in any combination.

Recitation of ranges of values herein are merely intended to serve as a shorthand method of referring individually to each separate value falling within the range, unless otherwise indicated herein, and each separate value is incorporated into the specification as if it were individually recited herein. For example, if a concentration range is stated as 1% to 50%, it is intended that values such as 2% to 40%, 10% to 30%, or 1% to 3%, etc., are expressly enumerated in this specification. These are only examples of what is specifically intended, and all possible combinations of numerical values between and including the lowest value and the highest value enumerated are to be considered to be expressly stated in this disclosure.

Although the present disclosure described with reference to humans, it is envisioned that the systems and methods described herein can also be As used herein, the term "subject" and "patient" are used interchangeably herein and refer to both human and nonhuman animals. The term "nonhuman animals" of the disclosure includes all vertebrates, e.g., mammals and non-mammals, such as nonhuman primates, sheep, dog, cat, horse, cow, chickens, amphibians, reptiles, and the like. The methods and compositions disclosed herein can be used on a sample either in vitro (for example, on isolated cells or tissues) or in vivo in a subject (i.e. living organism, such as a patient).

Unless otherwise defined, all technical terms used herein have the same meaning as commonly understood by one of ordinary skill in the art to which this disclosure belongs.

Like numbers refer to like elements throughout.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

One aspect of the present disclosure provides an electrochemical device that can switch between solar heating and radiative cooling mode to utilize renewable heating and cooling sources for building envelopes, wearable applications, and other heat management. The device is thin, lightweight, safe, and does not have any moving parts.

The heat transfer between the human body and environment through clothing mainly includes four mechanisms: conduction and convection, radiation, and sweat evaporation. Based on different forms of heat transfer, various passive smart textiles/wearables have been developed to regulate heat conduction and heat convection, heat radiation, or sweat evaporation to achieve personal thermal management. To enhance the functionality, sweat-responsive thermal regulation strategies have been demonstrated, which can automatically adjust the heat transfer coefficients in response to sweat vapor. These adaptive textiles/wearables have the tunability advantages as active thermal textiles/wearables but with minimal or even zero energy consumption, making them a promising new approach for personal thermal management. Currently, sweat-responsive thermoregulation can be divided into two categories. One is based on the bicomponent fibers that can convert the yarns between tight and loose forms. The other is based on the opening and closing of flaps. Compared with fiber actuators, the flap bimorph actuation has a more extensive tuning range due to the larger effective area. However, the reported moisture-responsive materials for flap configuration are much more costly than traditional textiles, and the tuning mechanisms are solely based on convection, both of which hinders further thermoregulation performance improvement. In particular, the potential of mid-infrared (mid-IR) management accounting for approximately 50% of the heat dissipation of our human body through radiation in typical indoor conditions has been overlooked. A much more extensive tuning range and more functionalities could be created if multiple heat transfer mechanisms can be incorporated to work synergistically as a "multimodal wearable". A comparison of current sweat-responsive thermoregulation technologies can be found in Table 1.

| | Materials | Tuning method | Flexibility | Open area for tuning | Radiation: low emissivity for heating | Radiation: high emissivity for cooling | Color design |
|---|---|---|---|---|---|---|---|
| Zhang et al. (23) | Bimorph fibers with carbon nanotubes | Yarn | Folded | ~35% | X | ✓ | X |
| Fu et al. (25) | Hydrophobic polyethylene terephthalate and hydrophilic cellulose fibers | Yarn | Folded | ~37% | X | ✓ | X |
| Wang et al. (22) | Biohybrid film | Flap | — | Not given | X | ✓ | X |
| Mu et al. (24) | Nafion | Flap | Flexible | Not given | X | ✓ | ✓ |
| Zhong et al. (21) | Nafion | Flap | Flexible | Not given | X | ✓ | X |
| Our work | Metallized nylon | Flap | Folded | ~80% | ✓ | ✓ | ✓ |

Figure 1B:
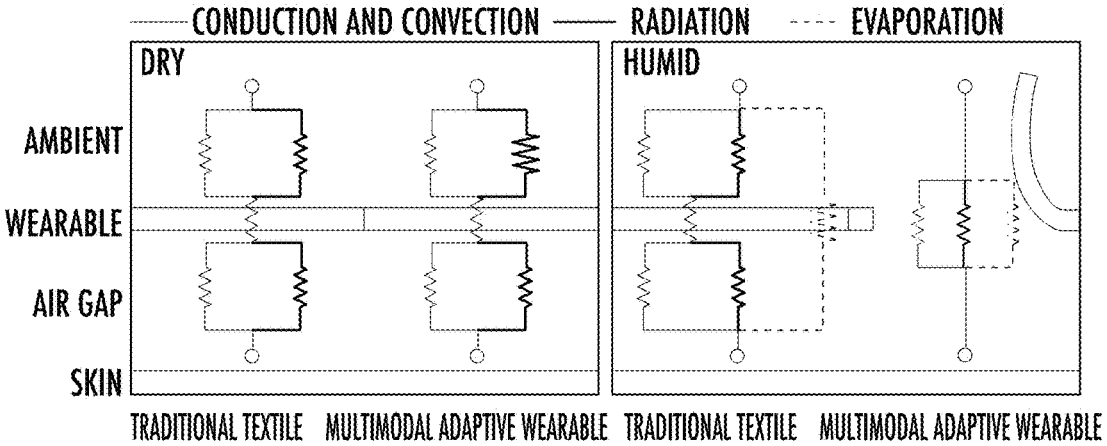
FIG. 1B is a schematic diagram providing an analysis of thermal resistance of traditional textile and the moisture-responsive wearable of FIG. 1A in dry (left) and humid (right) environments.

In this work, we demonstrate a multimodal smart wearable with moisture-responsive flaps composed of metalized nylon heterostructure, which can simultaneously regulate convection, mid-IR emission, and sweat evaporation by rational multifunctional designs of materials with proper mechanical, optical, and wearable properties (FIG. 1A). A polystyrene-block-poly(ethylene-ran-butylene)-block-polystyrene (SEBS) nanocomposite is used as the top passivation layer. As shown in FIG. 1B left, compared with traditional textile, our design with dry state features a low-emissivity layer that can suppress the radiation heat loss to achieve effective heating. In the humid state, the flaps open automatically to promote convection, radiation, and sweat evaporation (see FIG. 1B right) for cooling. The result showed a significant expansion of thermoregulation capability compared to traditional textiles and non-metallized nylon by 30.7% and 20.7%, respectively. Finally, we demonstrate that SEBS nanocomposite can provide an added feature of different colors without compromising the performance of thermal management.

Results and Discussion

Figure 1C:
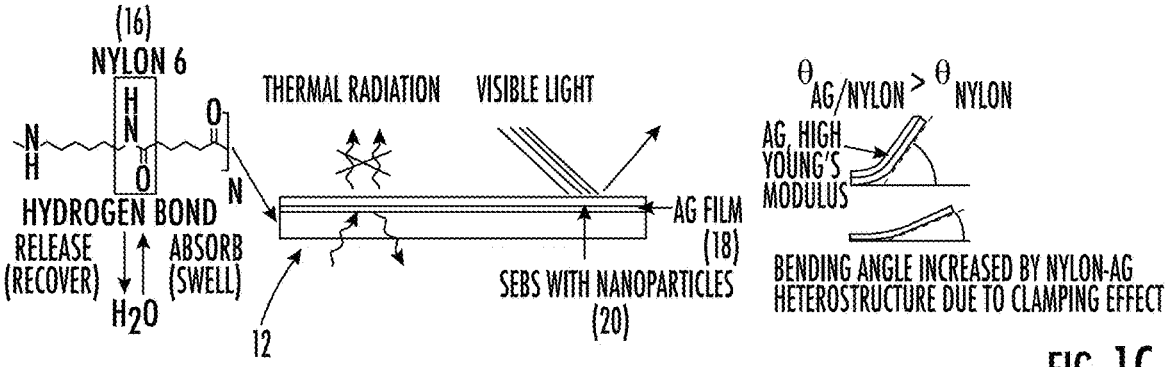
FIG. 1C is a schematic diagram illustrating the composition of the multimodal adaptive wearable: configuration of the nylon-Ag-SEBS heterostructure and the functional diagram of each layer. Bending of nylon-Ag actuator is augmented due to the clamping effect: smaller strain at the interface (compared to the unrestrained bottom surface of nylon) caused by depositing Ag layer, leads to increasing bending angle.

To achieve the multimodal thermal management, three layers (nylon, silver, and SEBS nanocomposite, see FIG. 1C) with an array of flaps (FIG. 1A) were carefully designed. As described in more detail herein, the multimodal wearable 10 may include a multilayer body 12 (also referred to herein as a multilayer "textile") and an array of a plurality of flaps 14 connected to the body 12. The multilayer body 12 may include a nylon layer 16 and a metal layer 18 on the nylon layer 16. The multilayer body 12 may optionally include a color layer 20.

1) Nylon-6 layer. As one of the most widely-used polyamides, nylon-6 can reversibly absorb and release water to achieve bimorph actuation by hygroscopic expansion. Specifically, the nylon flaps will bend towards the lower humidity when there is a humidity difference between the two sides and recover to their original state when the humidity difference vanishes. This humidity sensitivity is attributed to the amide (—CONH) group in the nylon chains, which can form hydrogen bonds with water molecules (see FIG. 1C, left). The opening and closing of these flaps can tune the convective and evaporative heat exchange between our human body and the ambient air (FIG. 1A). Compared with other reported moisture-responsive materials such as Nafion film, graphene oxide (GO) film, reduced GO film, and MXene film, nylon is one of the most common textile materials due to its low cost, high stability, and excellent mechanical properties, and it also has the advantage of mid-IR transparency (discussed below). 2) Ag layer. To incorporate radiative heat tuning to the nylon moisture-responsive actuator, a layer of Ag was deposited on the top surface to achieve low mid-IR emissivity. This layer effectively suppresses radiation loss when the flaps are closed in the dry state. Conversely, when the flaps are open under humid condition, radiative heat transfer increases because human skin is close to a perfect black body. Interestingly, it is found that the nylon film's actuation performance can be significantly enhanced by properly choosing the thickness of Ag film due to the clamping effect (see FIG. 1C, right). 3) SEBS nanocomposite. To increase the options of the wearable's visible appearance for aesthetic purposes, a top color layer was designed. This color layer needs to be mid-IR transparent to maintain the design's low emissivity. After careful analysis and screening, we chose the combination of SEBS polymer with Si, $Fe_2O_3$, and CuO nanoparticles, which can serve as effective mid-IR transparent coloration layers deposited by spray coating. We will further discuss these designs in the following paragraphs. The samples of the nylon-Ag actuators are labelled with Ag layer thickness indicated, for example, Nylon-Ag50 refers to the sample with 50-nm-thick Ag deposited on nylon.

Figure 2A:
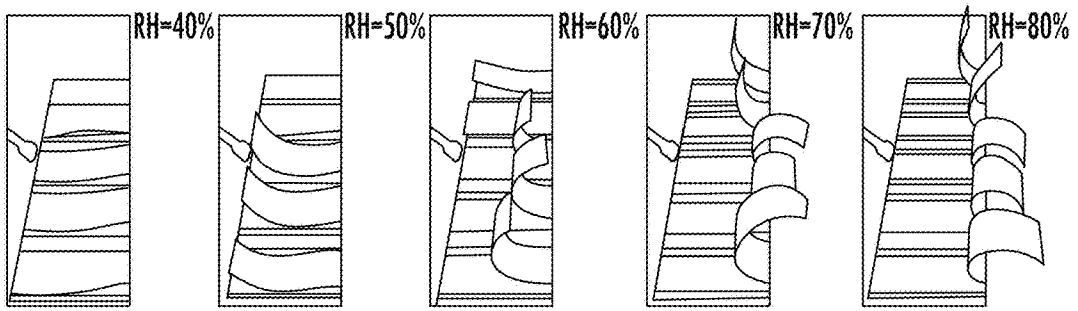
FIG. 2A are digital images of the bending process of nylon-Ag actuators (length: 2 cm, width: 1 cm) over different humidity.
Figure 2D:
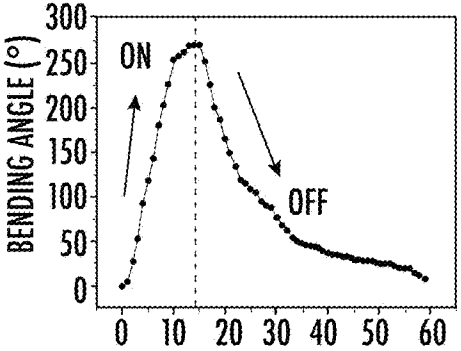
FIG. 2D is a chart illustrating the dynamic behavior of bending and recovery in response to moisture. The sample is nylon-Ag50.
Figure 2G:
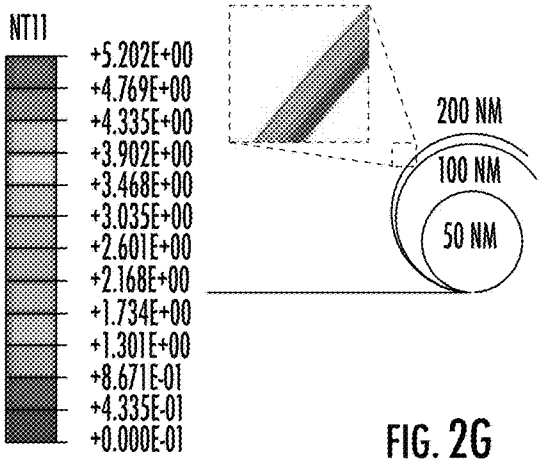
FIG. 2G includes FEA simulations of nylon-Ag bilayer film with various Ag layer thicknesses; the legend shows the temperature field (which corresponds to the water content gradient in the simulation) across the film.
Figure 2C:
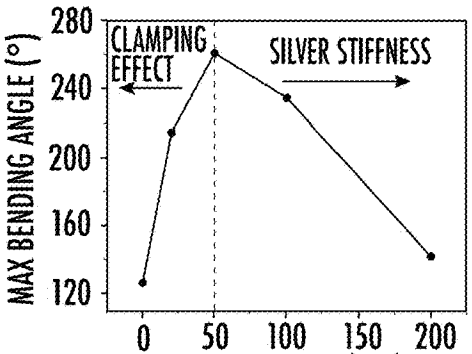
FIG. 2C is a chart illustrating the maximum bending angle vs the thickness of Ag.
Figure 2F:
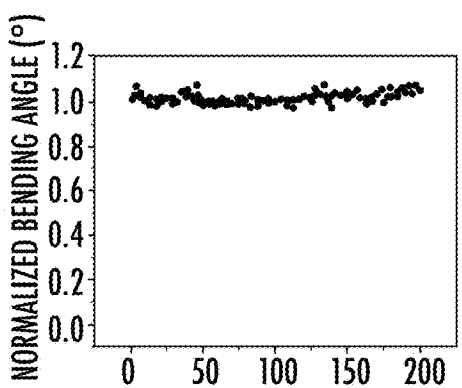
FIG. 2F is a chart illustrating the cycle performance of nylon-Ag50 actuator. The closing angle of each cycle is less than 5 degrees.
Figure 2B:
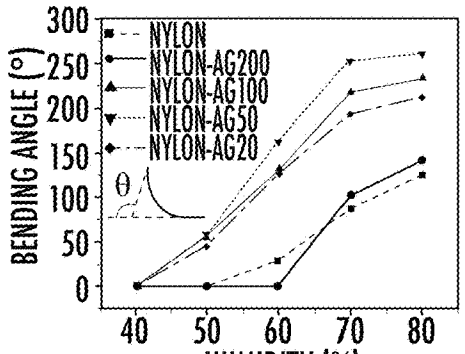
FIG. 2B is a chart illustrating the bending angle of nylon-Ag actuator with different thickness of Ag as a function of humidity (insert: definition of bending angle).
Figure 2E:
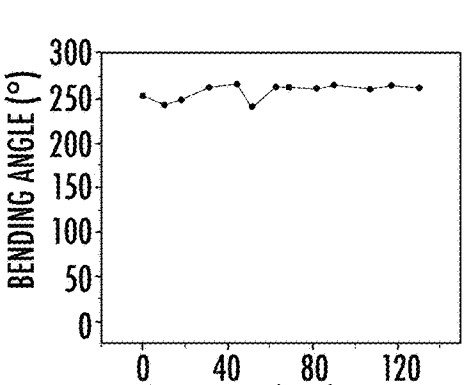
FIG. 2E is a chart illustrating the bending angle vs time at RH=80%.
Figure 6:
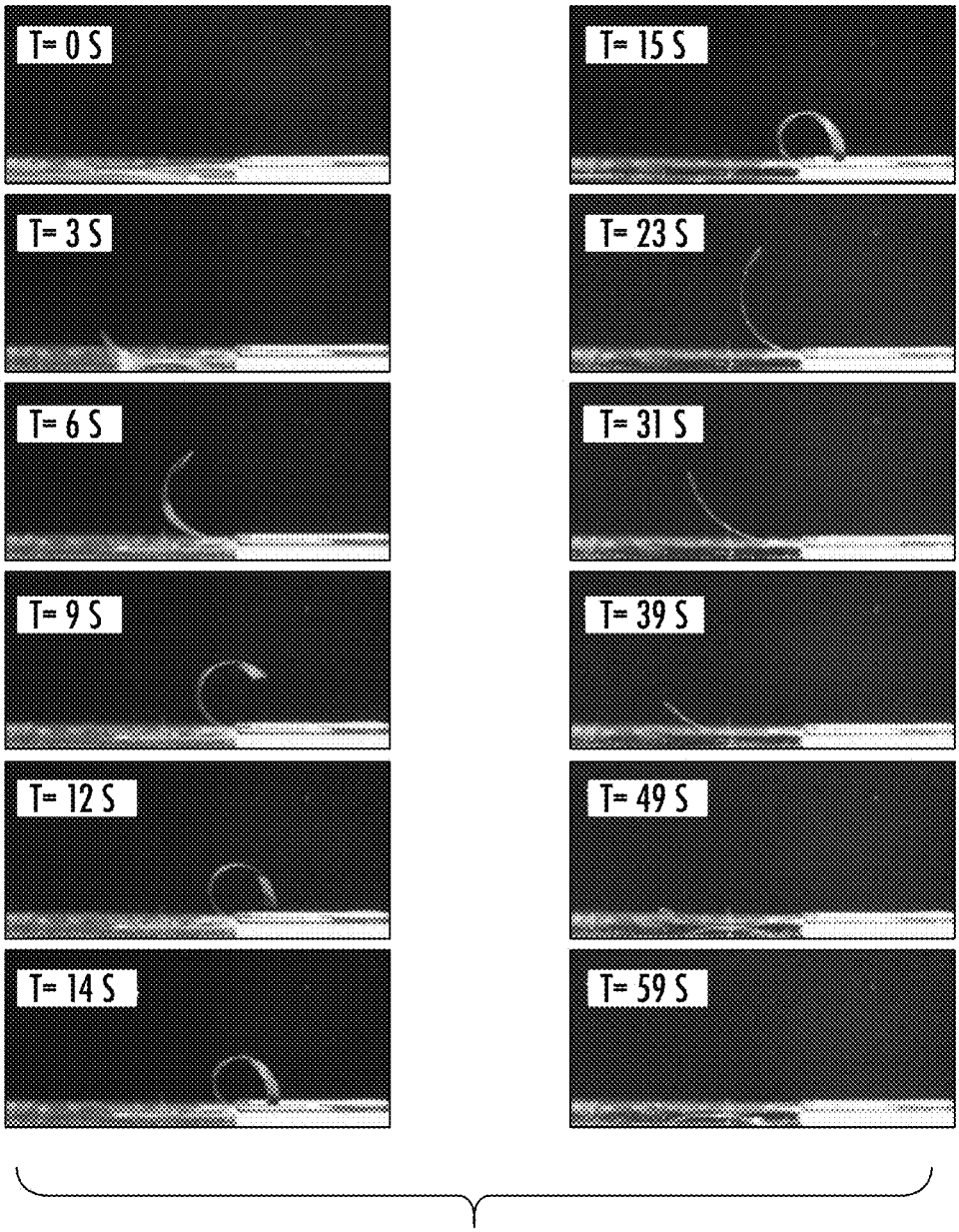
FIG. 6 includes digital images of bending/recovering motion of nylon-Ag50 actuator over time.
Figure 7:
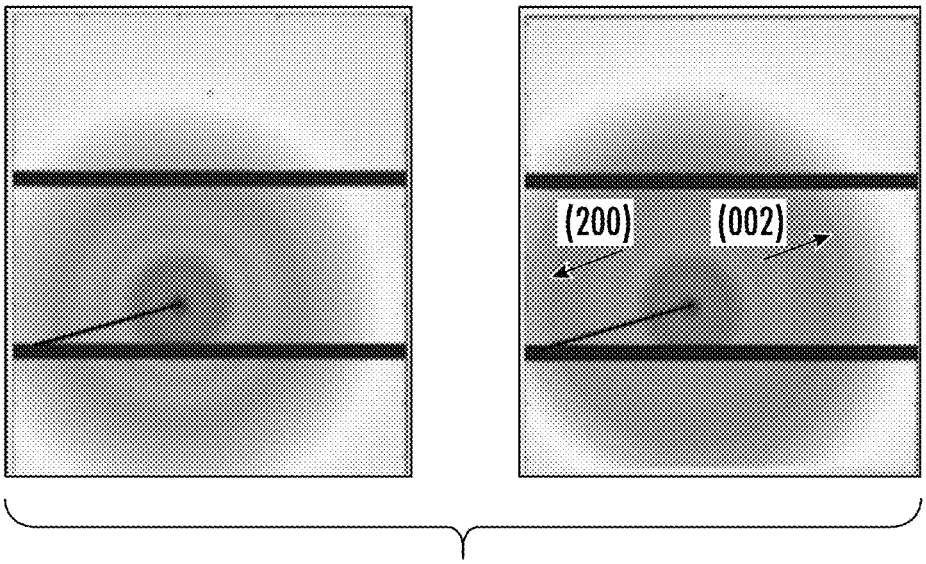
FIG. 7 provides a two-dimensional WAXD analysis of nylon. Two-dimensional WAXD patterns of the Kapton tape substrate (left) Kapton/nylon/Kapton (right).

To investigate the moisture-responsive properties of nylon-Ag actuator, as shown in FIG. 2A, a quantitative characterization of nylon's bending process with different thicknesses of Ag over humidity was carried out. As shown in FIG. 2B, the bending angle of Nylon-Ag50 can reach 260 degrees when moisture is introduced and increases the local humidity below the nylon film from 40% to 80%. Intriguingly, as shown in FIG. 2C, the maximum bending angle exhibits a non-monotonic trend, which increases initially as the Ag thickness increases and reaches the maximum at 50 nm before decreasing. Fundamental analysis is detailed in the next paragraph. In addition to the bending angle, the device's response time and stability are also critical figures of merit. As shown in FIG. 2D, Nylon-Ag50 can be fully opened in ~14 s when the relative humidity (RH) changes from 40% to 80% and return to the initial state at ~45 s when the RH gradient disappears (the corresponding optical images can be seen in FIG. 6). If the humidity is maintained at 80%, the actuator's bending angle is unchanged for 2 hours (FIG. 2E). Apart from having good bending properties and response time, the Nylon-Ag50 also exhibits excellent stability showing an unchanged bending angle after 200 cycles (FIG. 2F). Moreover, two-dimensional wide-angle X-ray scattering (WAXS) patterns of nylon films also demonstrate no apparent preferred orientation of the nylon film, so it can be treated as an isotropic semicrystalline film for analysis (FIG. 7).

In order to understand the effect of the deposited Ag nanolayer on the hygroscopic behavior of the nylon film, simplified analytical mechanical modeling was carried out. Defining $\lambda$ as the expansion ratio of the nylon film upon moisture absorption, $t_1$ and $t_2$ as thickness of Ag and nylon layers, respectively, mechanical equilibrium requires that the net forces and moments of the bilayer structure be zero. This constraint yields the absolute value of the radius of curvature at equilibrium:

$$|R| = \frac{A(1-\lambda)t_1^4 + 2(2+\lambda)t_1^3 t_2 + 3(2+\lambda)t_1^2 t_2^2 + 4t_1 t_2^3 + \frac{1}{A}t_2^4}{6\lambda t_1 t_2 (t_1 + t_2)} \quad (1)$$

where $A=E_1/E_2$, $E_1$ and $E_2$ are modulus of Ag and nylon layers, respectively. A smaller value of $|R|$ corresponds to a larger bending angle. The equation above provides a numerical explanation of the impact of a thin layer of high modulus material on the bending behavior of the nylon film. First note that the magnitude of the modulus ratio, A, is ~138, since Ag has a Young's modulus ~83 GPa (33) and the nylon film's Young's modulus is ~0.6 GPa, as measured in experiments with water absorbed. Therefore, the contributions from the $t_2$ term is decreased while the contribution from the $t_1$ term is increased, both by the factor of ~138; since $t_2 >> t_1$, the overall effect is a reduction in the radius of curvature, i.e., an augmented bending of the nylon film. From a physical sense, due to the competition of the swelling of the nylon vs the restraint of the Ag layer, at the interface of Ag and nylon the Ag coating undergoes expansion whereas nylon film experiences contraction. Therefore, a high Young's modulus of the coating layer gives rise to a smaller amount of strain at the interface (compared to the unrestrained swelling strain at the lower surface of the nylon), which results in an increase in bending angle of the composite film.

The analytical result also shows a non-monotonic trend in the thickness-dependent hygroscopic behavior of the nylon-Ag film, which agrees with the trend observed in the experiments (FIG. 2C). The significant thickness contrast and stiffness differential between the two layers results in a resistance to bending at both limits of the Ag layer thickness, leading to the non-monotonic trend mentioned above and therefore an optimum thickness of Ag layer for the nylon-Ag actuator. However, the optimum thickness of the Ag layer obtained by the analytical model still has discrepancy from the experimental result, even when considering a gradient water concentration within the nylon film, this could be partially due to the variation in the Young's modulus of the Ag layer resulting from a different synthesis method. Therefore, finite element analysis (FEA) was performed to further investigate this discrepancy. FEA simulations of a two-dimensional bilayer structure have validated our simplified analytical model for the cases where the two layers have similar Young's moduli (e.g. 83 GPa and 20 GPa), whereas for cases where the two layers have a larger Young's modulus mismatch, the analytical model is not fully able to capture the Ag layer thickness dependence of the bending behavior of the bilayer structure. The lack of accuracy of the analytical model may arise from omission of the shear forces between the two layers.

A series of 2D FEA simulations of bilayer structures that characterize the mechanical properties of both nylon and Ag layers were carried out using ABAQUS. The thermal expansion analysis included in ABAQUS was used as an analog for the hygroscopic behavior of the nylon film. One end of the bilayer film is fixed, as in the experimental set-up (FIG. 2A), and a temperature gradient is used to mimic the humidity gradient. As shown in FIG. 2G, one can see that as the thickness of Ag layer decreases, the bilayer film bends more with Nylon-Ag50 leading to the largest bending angle, aligning with the optimum thickness observed in experiments. According to FEA simulations, the bilayer film starts showing reduction in bending as the Ag layer thickness decreases from 50 nm to 40 nm (see Table 2), replicating the non-monotonic trend of the analytical model and experimental data.

Figure 3A:
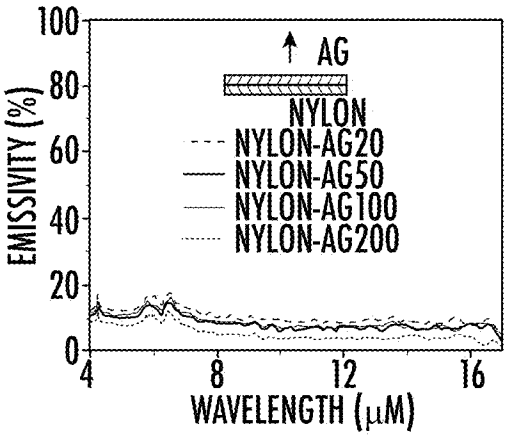
FIG. 3A is a chart illustrating mid-IR emissivity of nylon-Ag actuators (from Ag side).
Figure 3B:
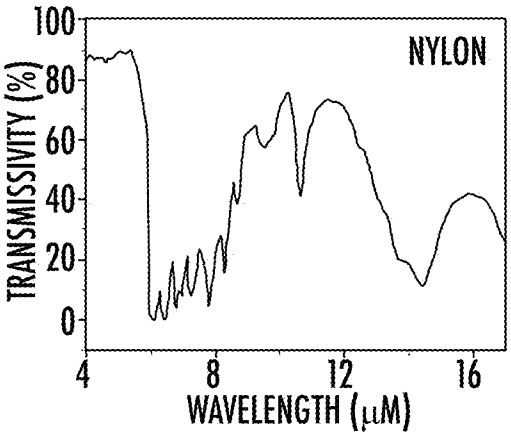
FIG. 3B is a chart illustrating mid-IR transmissivity of nylon film.
Figure 3C:
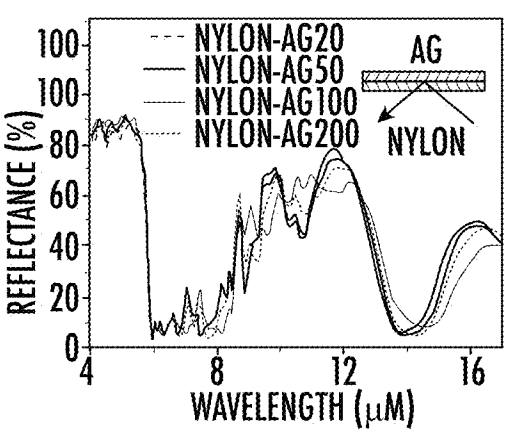
FIG. 3C is a chart illustrating mid-IR reflectance of nylon-Ag actuators (from nylon side).
Figure 3D:
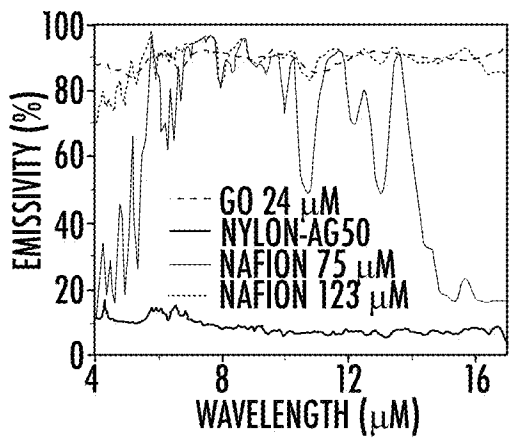
FIG. 3D is a chart illustrating mid-IR emissivity of other exemplar moisture-responsive actuator materials.
Figure 3E:
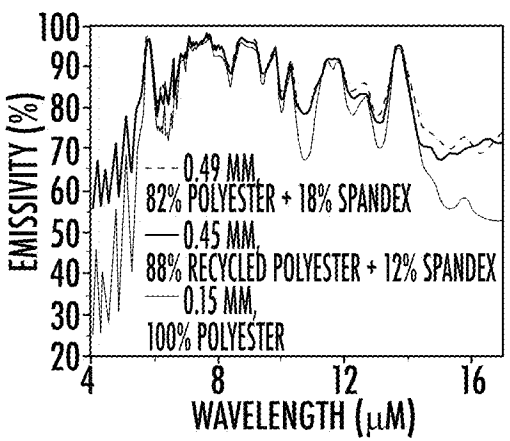
FIG. 3E is a chart illustrating mid-IR emissivity of traditional textiles.
Figure 3F:
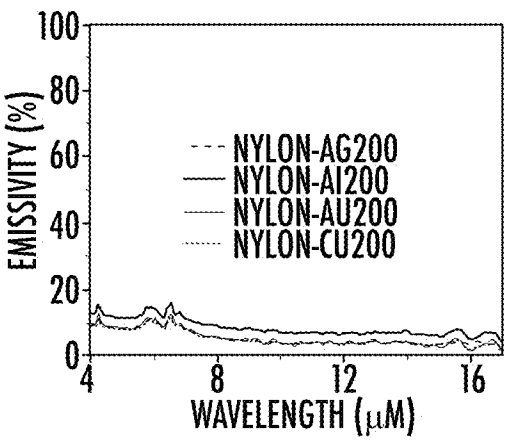
FIG. 3F is a chart illustrating mid-IR emissivity of nylon with different metals.

As mentioned above, the metal layer not only improves nylon's bending performance but also suppress the infrared emission of the human body. FIG. 3A shows the mid-IR emission of nylon-Ag actuator. It can be seen that even with only a 20-nm-thick Ag layer, its emissivity can be reduced to only 0.1, which is around 8-9 times smaller than traditional textiles and other stimuli-responsive materials, resulting in superior heating effect in the dry state. Additionally, pristine nylon has ~44% transparency in mid-IR (FIG. 3B), so the top Ag layer can also increase the mid-IR reflectivity from below, which directly reflects and traps human body's thermal radiation to achieve even stronger thermal insulation effect (FIG. 3C). Because the Ag layer is opaque to mid-IR, one can also interpret the heating effect by the low emissivity probing from the nylon side. It is worth noting that this low mid-IR emissivity has not been observed in other material systems, e.g., graphene oxide, Nafion, etc. (FIG. 3D) and traditional textiles (FIG. 3E). Also, it can be shown that other metals behave very similar with Ag in mid-IR. For example, the mid-IR emissivity of Au, Al, and Cu can all reach<10% (FIG. 3F), indicating the universality, cost-effectiveness, and scalability of the metal/nylon approach.

Figure 4A:
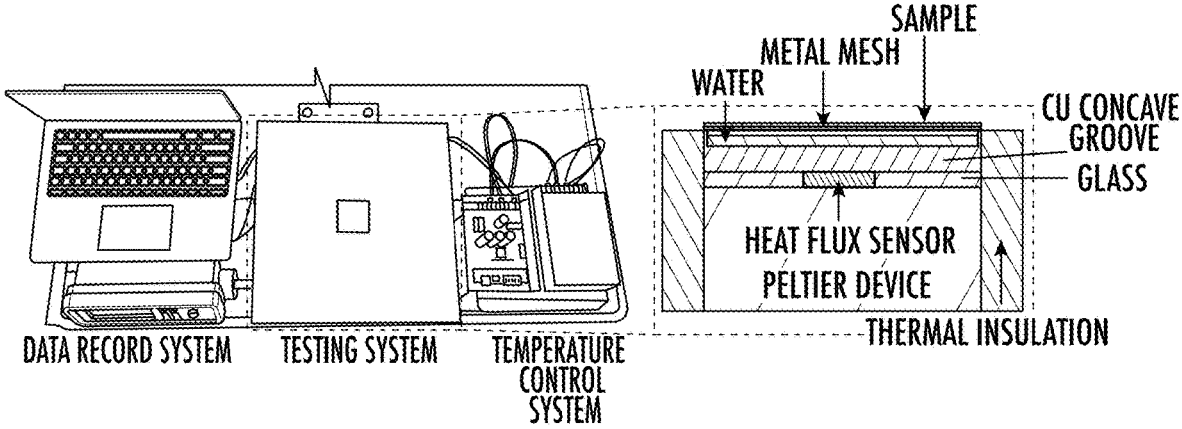
FIG. 4A illustrates the overall system and schematic of testing setup.
Figure 4B:
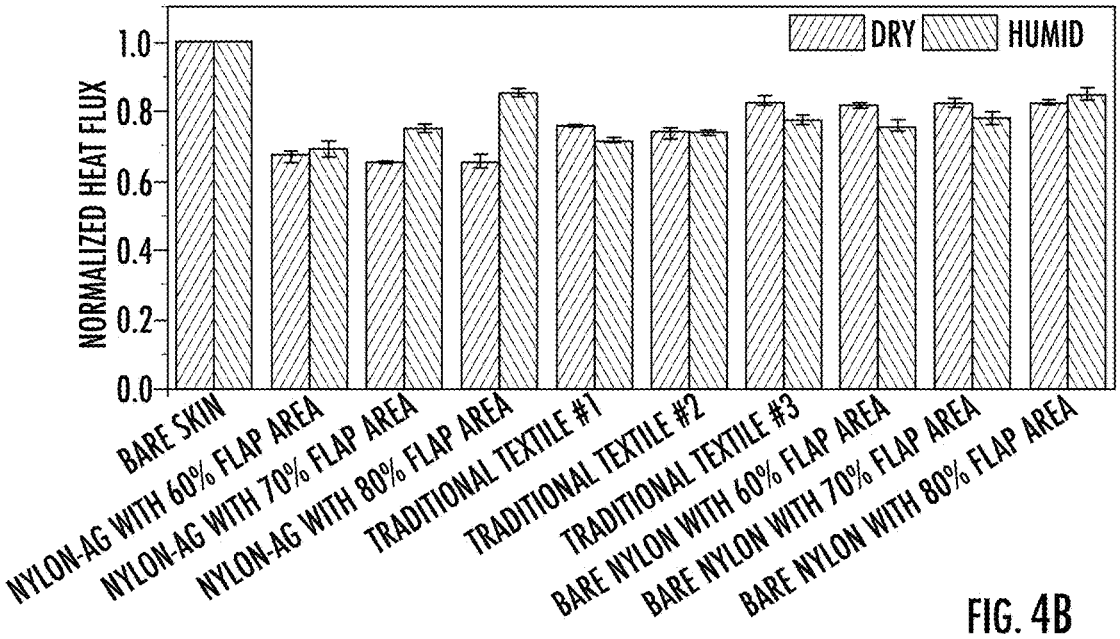
FIG. 4B is a chart illustrating normalized heat flux of different types of textiles/wearables at dry and humid state. The thickness of nylon-Ag and bare nylon wearables is 17 μm (Ag thickness is negligible). Traditional textile #1: 82% polyester+18% spandex (490 μm thick); Traditional textile #2: 88% polyester+12% spandex (450 μm thick); Traditional textile #3: 100% polyester (150 μm thick). The error bars in FIG. 4B represent the standard deviation of three independent measurements. In the humid test conditions, the relative humidity under flaps is >95%.
Figure 8A:
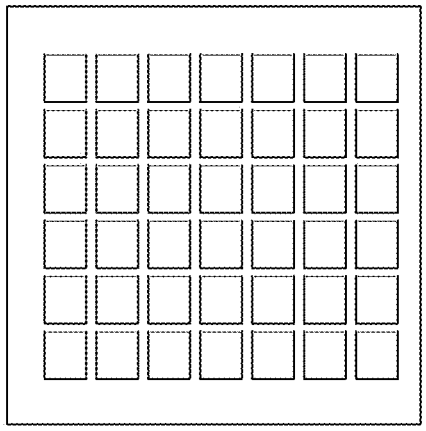
FIG. 8A is a digital image of the nylon-Ag film with flaps closed.
Figure 8B:
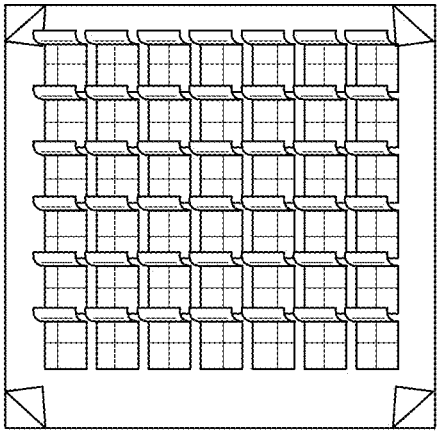
FIG. 8B is a digital image of the nylon-Ag film with flaps closed.

The proper design of mid-IR and actuation properties leads us to conduct heat transfer measurements to quantify the multimodal adaptive heat management performance. As shown in FIG. 4A, the testing system features a Peltier temperature control feedback system including temperature control system and testing system (see FIG. 4A left) and a data recording system. In this system, a PID control program is employed to fix the carbon-coated copper concave groove's temperature with/without water to simulate the human skin at humid/dry state (Under humid conditions, the relative humidity>95%). At steady state, the heat flux supplied by the Peltier device equals the heating or the cooling generated by simulated skin with cloth, measured by the heat flux sensor between the Peltier device and the copper concave groove (see FIG. 4B right, more details can be found in method). For fair comparison and data interpretation, we normalized the heat flux based on the bare skin, i.e., no wearable sample. Ideally, to help the user adapt to large ambient temperature fluctuation, the adaptive wearable should suppress the normalized heat flux at dry state (flaps closed, FIG. 8A) and increase the normalized heat flux at humid state (flaps open, FIG. 8B). As shown in FIG. 4B, at dry state, the normalized unitless heat flux of traditional textile #1, #2, and #3 is 0.76, 0.74, and 0.83, and the three bare nylon samples with different flap area all show 0.82 of normalized heat flux. In contrast, nylon-Ag wearables effectively suppressed the heat loss because of the radiative heating design, which achieves 0.65 of normalized heat flux. Note that this significant heating performance is achieved by the nylon-Ag wearable that is only 17 μm thick, which is approximately 20 times thinner than traditional textiles. This surface-sensitive characteristic is also one of the unique advantages of radiative heat management. Also, in FIG. 4B, the humid bars show the heat fluxes normalized to humid skin. Traditional textile #1, #2, and #3 are 0.71, 0.74, and 0.78 respectively. For both bare nylon and nylon-Ag wearables, the moisture-responsive actuation allows convection and evaporation, so the heat flux of cooling performance increases as the flap area increases. In particular, the normalized heat flux of nylon-Ag wearable with 80% flap area can reach 0.85, which is the largest among all samples. Compared with traditional textiles, on average, the nylon-Ag wearable is warmer by 16.3% in the dry state and cooler by 14.4% when humid. In other words, the nylon-Ag wearable can expand the thermal comfort zone by 30.7%. As for the bare nylon, even though it is capable of moisture-responsive thermoregulation, it is still outperformed by the nylon-Ag wearable by 20.7%. The difference mainly lies in the heating performance at dry state, which indicates the importance of incorporating radiation into thermal engineering. This large tunability clearly demonstrates the efficacy of employing multimodal design for adaptive heat management to achieve extended-range thermal comfort stabilization.

Figure 9A:
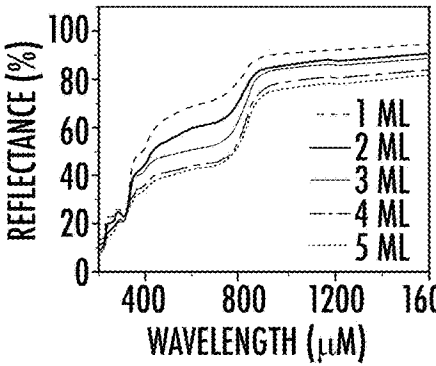
FIG. 9A is a chart illustrating visible reflectance of nylon/Ag wearable with different concentration of CuO nanoparticles/SEBS.
Figure 9B:
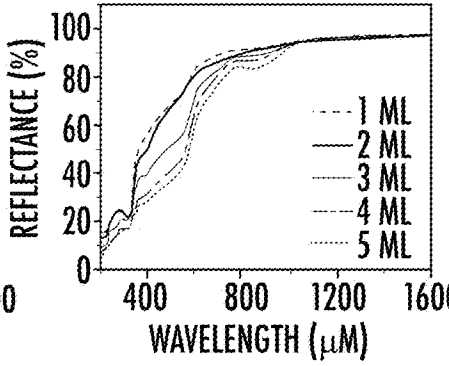
FIG. 9B is a chart illustrating visible reflectance of nylon/Ag wearable with different concentration of $Fe_2O_3$ nanoparticles/SEBS.
Figure 9C:
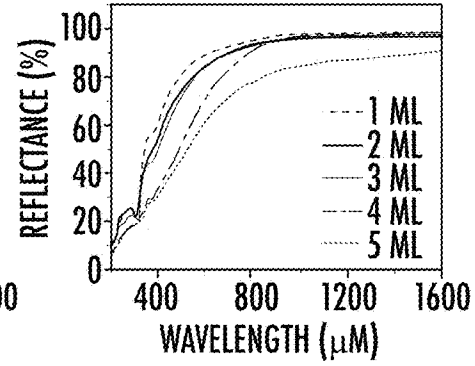
FIG. 9C is a chart illustrating visible reflectance of nylon/Ag wearable with different concentration of Si nanoparticles/SEBS.
Figure 10:
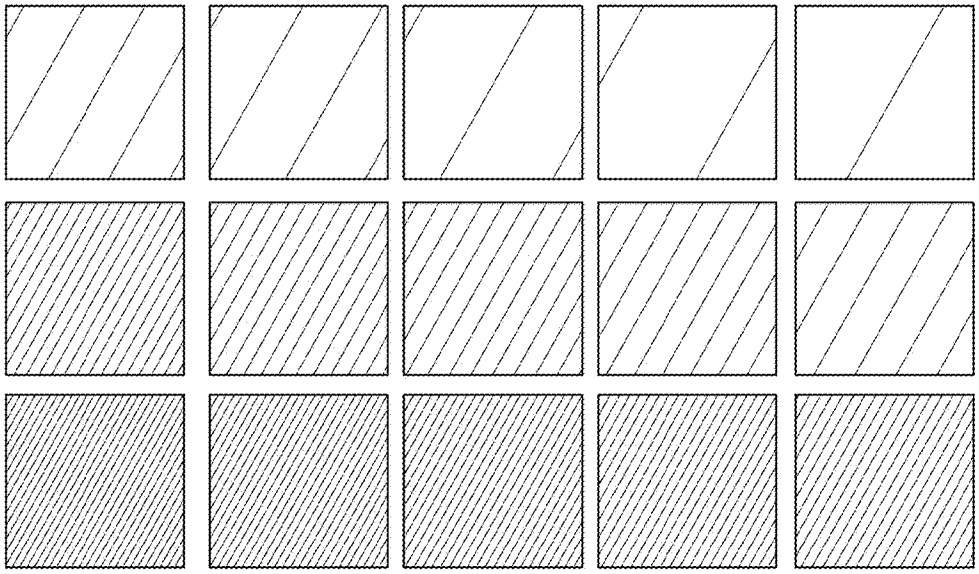
FIG. 10 includes optical images of nylon-Ag wearable with different concentration (From left to right are 5 ml, 4 ml, 3 ml, 2 ml and 1 ml, respectively) of Si nanoparticles/SEBS (top), $Fe_2O_3$ nanoparticles/SEBS (middle), and CuO nanoparticles/SEBS (bottom), respectively.

In addition to thermal management, the color design for wearables is also an important factor for practical use. However, it is nontrivial to simultaneously achieve low emissivity and visual color because traditional organic dyes have strong absorption in mid-IR, e.g., C—O stretching (7.7-10 μm), C—N stretching (8.2-9.8 μm), aromatic C—H bending (7.8-14.5 μm), and S=O stretching (9.4-9.8 μm) (34). After careful analysis and screening, we found that the combination of SEBS with CuO, $Fe_2O_3$, and Si nanoparticles can achieve different colors while maintaining the low emissivity because of the nanocomposites' high transmissivity in mid-IR. As shown in FIG. 5A, black, brown, and light yellow can be achieved by doping CuO, $Fe_2O_3$, and Si nanoparticles, respectively (the corresponding visible reflection can be found in FIG. 4B and FIG. 8). The color depth is adjusted by varying the concentration of SEBS nanocomposites (FIG. 9). As shown in FIGS. 5C-5E, the color layer design only slightly increases the mid-IR emission of the wearable. Similarly, the device's bending performance was also well-maintained (FIG. 10). Finally, the device was attached to the backside of a commercially available T-shirt (back) for outdoor experiments on a volunteered human subject. As shown in FIG. 5F top, the flaps of the device are in the closed state at the beginning. When the subject starts to exercise (~5 min), the device's flaps are fully opened (FIG. 5F middle and FIG. 5G). As expected, when the subject stopped exercising and the sweat vapor fully disappeared, the device's flaps returned to the initial closed state (FIG. 5F bottom and FIG. 5H). Note: this demonstration is to show the attributes of its moisture response under real conditions. Other ways of usage, such as direct contact with the skin or attaching to a very thin textile is also possible.

In summary, we demonstrate a new metalized nylon-based multimodal smart wearable with sweat vapor-actuated low-emissivity flaps, which can synergistically regulate convection, mid-IR emission, and sweat evaporation from the human body to the ambient air. With rational designs of optical and mechanical properties, we demonstrated that the nylon-Ag wearable could significantly expand the adaptability by 30.7% more than traditional static textiles. In the future, we anticipate large-scale manufacturing can be achieved by the metallization tools widely used in packaging industry, such as antistatic bags and oxygen-blocking films. We also envision that with further development of advanced materials, printing process, patterning techniques, and dynamic designs, the multimodal adaptive wearables will bring immense opportunities for energy efficiency and wearable technology.

EXAMPLE

Materials and Methods

Preparation of Nylon-Ag Film and Nylon-Ag/Polystyrene-Block-Poly(Ethylene-Ran-Butylene)-Block-Polystyrene (SEBS) with Nanoparticles The silver film with different thicknesses was deposited onto the nylon film (17 μm thick, Goodfellow company) using the evaporator (Kurt Lesker PVD 75). For the preparation of nylon-Ag/SEBS with nanoparticles film, 5 wt % SEBS (M.W.=89,000, Sigma-Aldrich) solution was prepared by dissolving SBES in Hexane (Sigma-Aldrich) at 60° C. Then, 0.1 g of silicon nanoparticles (99%, 100 nm, SkySpring Nanomaterials, Inc.), 0.5 g of iron oxide nanoparticles (99%, 20-40 nm, SkySpring Nanomaterials, Inc.), 0.5 g of copper oxide nanoparticles (99%, 40 nm, SkySpring Nanomaterials, Inc.) were added to 50 g of 5 wt % SEBS solution respectively. After sonication for 20 min, 5 ml, 4 ml, 3 ml, 2 ml, 1 ml of the colored solution were sprayed by using an airbrush gun (PB-KTG, Fy-Light) to Ag film side of nylon-Ag film (6 cm by 6 cm), which was heated to 60° C. on a hot plate. Finally, heat the sample for another 10 min to ensure evaporation of Hexane. A rectangular array of flaps on nylon-Ag film or nylon-Ag/SEBS with nanoparticles was cut using the razor blade.

Characterizations

The reflectance of nylon-Ag film and nylon-Ag/SEBS with nanoparticles was measured by the UV-Visible-NIR spectrometer with a calibrated BaSO4 integrating sphere (300-1600 nm, Agilent technologies, Cary 6000i) and the Fourier Transform Infrared (FTIR) spectrometer with a diffuse gold integrating sphere (4-17 μm, Thermo Scientific, iS50). Sample surfaces were analyzed with a 3-D non-contact surface profiler, Zygo New View 5000 (Zygo, Middlefield, CT, USA). The nylon films were characterized by X-ray diffraction (XRD), using the Panalytical X'Pert PRO MRD HR XRD System, with CuKα radiation (λ=1.5418 Å), 40 kV, 40 mA, and scanning 2θ from 10° to 30° at a scanning rate of 0.05°/s. Wide angle X-ray scattering data were measured using SAXS Lab Ganesha instrument (SAXS LAB ApS, Skovlunde, Denmark), which is a point-collimated pinhole system and a 2D Dectris Pilatus 300 k 20 Hz Detector equipped with Xenocs Genix ULD SL X-ray Source operating at 50 kV. During the measurement of scattering intensity, source-to-detector distances were set to be able to cover the wave vector range $0.07<q<2.8$ Å−1. The 2D scattered pattern was monitored using the detector and then radially averaged using SAXS Gui software.

Sample Bending Curvature Measurement

Figure 11:
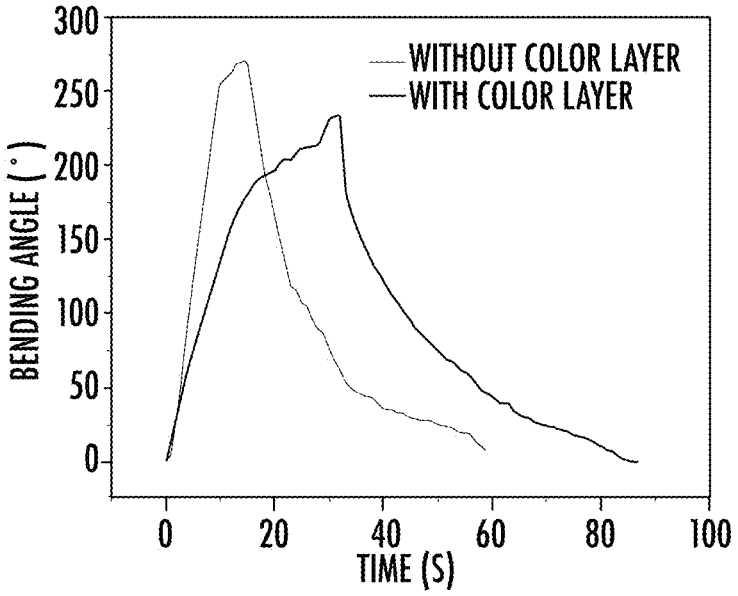
FIG. 11 is a chart illustrating the comparison of bending performance of nylon-Ag actuator with color layer ($Fe_2O_3$ nanoparticles/SEBS (5 ml)) and without color layer.

A humidity-controlled chamber was built for the sample bending curvature measurement (as shown in FIG. 11). Low humidity and high humidity air supplies were connected to the chamber and controlled by two valves. The chamber's top surface was not sealed and had 1 cm*2 cm holes, allowing samples to be exposed to different humidity environments. A digital humidity sensor SEK-SHT31-Sensors (Sensirion Co. Ltd.) was placed right under the sample to measure humidity and temperature simultaneously. The resolution is 0.01% RH and 0.01° C., respectively. For bending curvature measurement of nylon with different Ag film thickness, humidity in the chamber was adjusted from 40% to 80%. Photos of the samples at different humidity levels were taken by a camera positioned at the same level as the samples.

Heating Power and Cooling Power Measurement

Figure 12:
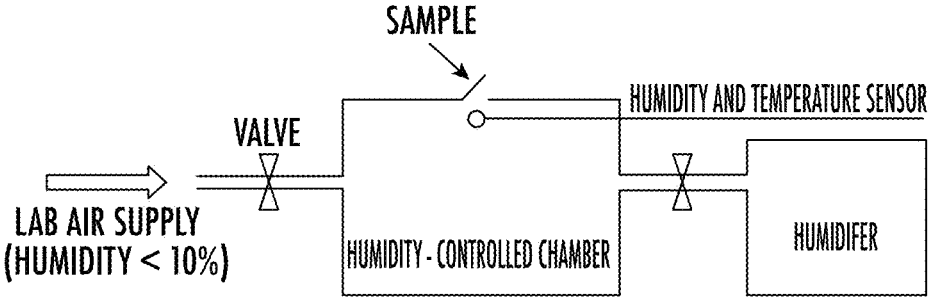
FIG. 12 is a schematic diagram of sample hygroscopic bending curvature measurement equipment.
Figure 13A:
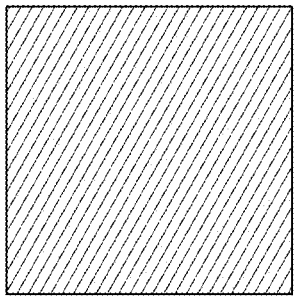
FIG. 13A is an optical image of copper plate with carbon grease.
Figure 13B:
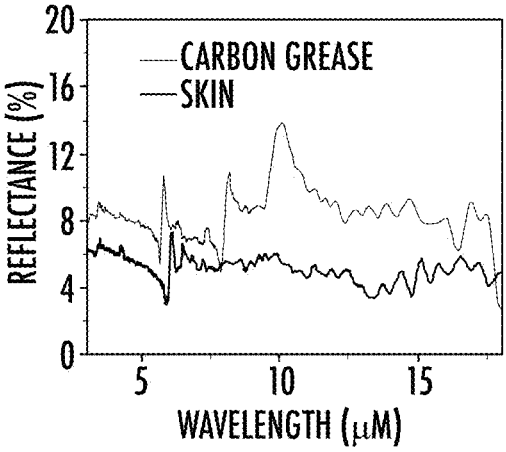
FIG. 13B is a chart illustrating mid-IR reflectance of skin and carbon grease.

FIG. 4A shows the schematic of equipment, which can quantitatively test the heating power and cooling power. From the top surface, it involves metal mesh, copper concave groove (Width: 5 cm, Length: 5 cm, Thickness: 4 mm, Groove depth: 3 mm, the inner side of groove was coated with a layer of carbon to simulate the emissivity of human skin (see FIG. 12)) with/without 1-2 mm height of the water, heat flux sensor of 1 mm thick (Electro Optical Components, Inc., A-04457) surrounded by glass with the same thickness, PID-controlled Peltier device (TE Technology Inc., TC-36-25). Thermal grease (Dow Corning, 340) was applied to ensure good thermal contact among different parts. The testing equipment's sidewall is wrapped with polyurethane foam of about 5 cm thick to avoid heat losses. During the testing process, the copper plate's temperature is kept at 33° C. by using the PID program to simulate the human skin temperature, and the ambient temperature is 23° C. At steady-state, the supplied heating power compensates for the copper plate's heat dissipation, and the heat flux sensor measures the corresponding cooling power or heating power in $W/m^2$.

Another embodiment of the present disclosure provides a method of thermoregulation using a system as disclosed herein.

Another aspect of the present disclosure provides all that is described and illustrated herein.

One skilled in the art will readily appreciate that the present disclosure is well adapted to carry out the objects and obtain the ends and advantages mentioned, as well as those inherent therein. The present disclosure described herein are presently representative of preferred embodiments, are exemplary, and are not intended as limitations on the scope of the present disclosure. Changes therein and other uses will occur to those skilled in the art which are encompassed within the spirit of the present disclosure as defined by the scope of the claims.

No admission is made that any reference, including any non-patent or patent document cited in this specification, constitutes prior art. In particular, it will be understood that, unless otherwise stated, reference to any document herein does not constitute an admission that any of these documents forms part of the common general knowledge in the art in the United States or in any other country. Any discussion of the references states what their authors assert, and the applicant reserves the right to challenge the accuracy and pertinence of any of the documents cited herein. All references cited herein are fully incorporated by reference, unless explicitly indicated otherwise. The present disclosure shall control in the event there are any disparities between any definitions and/or description found in the cited references.

Another embodiment of the present disclosure provides a method of thermoregulation using a system as disclosed herein.

Another aspect of the present disclosure provides all that is described and illustrated herein.

One skilled in the art will readily appreciate that the present disclosure is well adapted to carry out the objects and obtain the ends and advantages mentioned, as well as those inherent therein. The present disclosure described herein are presently representative of preferred embodiments, are exemplary, and are not intended as limitations on the scope of the present disclosure. Changes therein and other uses will occur to those skilled in the art which are encompassed within the spirit of the present disclosure as defined by the scope of the claims.

No admission is made that any reference, including any non-patent or patent document cited in this specification, constitutes prior art. In particular, it will be understood that, unless otherwise stated, reference to any document herein does not constitute an admission that any of these documents forms part of the common general knowledge in the art in the United States or in any other country. Any discussion of the references states what their authors assert, and the applicant reserves the right to challenge the accuracy and pertinence of any of the documents cited herein. All references cited herein are fully incorporated by reference, unless explicitly indicated otherwise. The present disclosure shall control in the event there are any disparities between any definitions and/or description found in the cited references.

We claim:

1. A multimodal wearable for thermoregulation, the multimodal wearable comprising:

a multilayer body comprising a hygroscopic polymer layer and a metal layer on the hygroscopic polymer layer;

a color layer on the metal layer; and an array of a plurality of flaps pivotally connected the body, wherein the flaps move from a closed state to an open state in response to human perspiration vapor.

2. The multimodal wearable of claim 1 wherein the hygroscopic polymer layer comprises nylon.

3. The multimodal wearable of claim 1 wherein the metal layer comprises silver.

4. The multimodal wearable of claim 1 wherein the metal layer has a thickness of about 50 nm±50%.

5. The multimodal wearable of claim 1 wherein each of the flaps is flat on the body in the closed state and is at a bend angle relative to the body in the open state.

6. The multimodal wearable of claim 5 wherein the bend angle is at least 200 degrees at 80% relative humidity.

7. The multimodal wearable of claim 1 wherein the plurality of flaps cover at least 75% of an area of the body.

8. The multimodal wearable of claim 1 wherein the emissivity of the wearable is less than 0.2 with the plurality of flaps in the closed state.

9. The multimodal wearable of claim 1 wherein the color layer comprises a polymer layer with nanoparticles dispersed therein.

10. The multimodal wearable of claim 9 wherein the nanoparticles comprise CuO nanoparticles to provide a black visual appearance.

11. The multimodal wearable of claim 9 wherein the nanoparticles comprise $Fe_2O_3$ nanoparticles to provide a brown visual appearance.

12. The multimodal wearable of claim 9 wherein the nanoparticles comprise Si nanoparticles to provide a light yellow visual appearance.

13. The multimodal wearable of claim 9 wherein the polymer layer comprises styrene-ethylene-butadiene-styrene (SEBS).

14. The multimodal wearable of claim 1 wherein the flaps pivot and/or curl in response to human perspiration vapor to thereby expose openings in the body.

15. The multimodal wearable of claim 1 wherein the flaps are in the closed state at a relative humidity of about 40% or less, wherein the flaps are in the open state at a relative humidity of about 80% or greater, and wherein the flaps are in a partially open state at relative humidity of between about 40% and about 80%.

16. A method of providing thermoregulation using a multimodal wearable, the method comprising:

providing a multimodal wearable comprising a multilayer body comprising a hygroscopic polymer layer and a metal layer on the hygroscopic polymer layer, a color layer on the metal layer, and an array of a plurality of flaps connected the body;

placing the wearable adjacent a human body; and automatically moving the flaps between a closed, flat state and an open state in response to a level of perspiration vapor from the human body.

17. The method of claim 16 wherein, in the open state, the flaps expose openings in the body in the open state to promote convection, radiation, and perspiration evaporation through the openings.

18. The method of claim 17 wherein, in the closed state, the flaps cover the openings such that the metal layer is continuous and has low emissivity to suppress radiation heat loss.

19. An article of clothing comprising:

a multilayer body comprising a nylon layer and a silver layer on the nylon layer;

a color layer on the silver layer; and an array of a plurality of flaps hingedly connected the body, wherein the flaps move to an open state in response to human perspiration vapor generating a relative humidity greater than a first threshold level, and wherein the flaps move to a closed state in response to human perspiration vapor generating a relative humidity less than a second threshold level, wherein a plurality of openings are formed in the body when the flaps are in the open state to promote convection, radiation, and perspiration evaporation, and wherein the silver layer is continuous with the flaps in the closed state to provide a low-emissivity layer to suppress radiation heat loss.

20. The article of clothing of claim 19 wherein the color layer comprises a polymer layer with nanoparticles dispersed therein.

* * * * *